United States Patent [19]

Forsgren et al.

[11] 4,042,737

[45] Aug. 16, 1977

[54] PROCESS FOR PRODUCING CRIMPED METAL-COATED FILAMENTARY MATERIALS, AND YARNS AND FABRICS OBTAINED THEREFROM

[75] Inventors: Klane F. Forsgren, Yardley; Sidney Melamed, Elkins Park, both of Pa.; Robert S. Weiner, Marietta, Ga.

[73] Assignee: Rohm and Haas Company, Philadelphia, Pa.

[21] Appl. No.: 564,186

[22] Filed: Apr. 1, 1975

Related U.S. Application Data

[63] Continuation-in-part of Ser. No. 415,916, Nov. 14, 1973, abandoned, which is a continuation of Ser. No. 263,808, June 19, 1973, abandoned, which is a continuation of Ser. No. 76,246, Sept. 28, 1970, abandoned.

[51] Int. Cl.[2] ..... B05D 5/12; D02G 1/00

[52] U.S. Cl. ..... 428/96; 428/92; 428/253; 428/369; 428/389; 428/378; 428/395; 428/458; 428/922; 427/123; 427/125; 427/304; 427/401; 28/247; 28/258

[58] Field of Search ..... 28/72 P, 72 CS, 72.1, 28/72.16, 74 R, 74 P, 75 R, 75 WT; 428/253, 369, 96, 92, 922, 389, 378, 395, 458; 427/123, 125, 304, 306, 401

[56] References Cited

U.S. PATENT DOCUMENTS

| | | | |
|---|---|---|---|
| 2,907,678 | 10/1959 | Bodmer et al. | 428/253 |
| 3,438,106 | 4/1969 | Cohn et al. | 28/74 |
| 3,582,445 | 6/1971 | Okuhashi | 428/96 |
| 3,582,448 | 6/1971 | Okuhashi et al. | 428/242 |
| 3,666,550 | 5/1972 | Okuhashi et al. | 428/253 |
| 3,686,019 | 8/1972 | Ohfuka et al. | 427/304 |
| 3,792,520 | 2/1974 | Weaver | 427/123 |

FOREIGN PATENT DOCUMENTS

| | | | |
|---|---|---|---|
| 396,219 | 8/1933 | United Kingdom | 28/72.16 |

*Primary Examiner*—Ralph S. Kendall

[57] ABSTRACT

Process for the production of a crimped metal-coated continuous-filament or a crimped yarn of a plurality of metal-coated filaments which filament or yarn is adapted for combination with other filaments to form an improved yarn for use in making anti-static fabrics, such as pile carpets or the like, wherein the continuous-filament or yarn comprising a plurality of filaments is first made into a knitted fabric, the fabric is treated to deposit a continuous metal coating on the filament or yarn thereof, and the coated fabric thus obtained is deknitted, thereby yielding the metal-coated continuous-filament or yarn in a crimped disposition characteristic of the knitted loop construction existing in the knit fabric. Heat treatment of the crimped filament or yarn after the metal-coating step significantly improves its anti-static properties when incorporated into fabric.

16 Claims, No Drawings

PROCESS FOR PRODUCING CRIMPED METAL-COATED FILAMENTARY MATERIALS, AND YARNS AND FABRICS OBTAINED THEREFROM

BACKGROUND OF THE INVENTION

This application is a continuation-in-part of copending application Ser. No. 415,916 filed Nov. 14, 1973 now abandoned, the latter being a continuation of application Ser. No. 263,808 filed June 19, 1973, now abandoned, which in turn, is a continuation of application Ser. No. 76,246, filed Sept. 28, 1970, also now abandoned.

This invention relates to a method for making a novel textured filament or yarn having anti-static characteristics. This invention also relates to carpets having essentially the characteristic of the predominant fiber except for a substantially decreased tendency for accumulation of static charge.

A number of approaches have been employed in an attempt to provide an anti-static yarn, i.e., a yarn with a reduced tendency to accumulate static charge. Among the approaches that have been attempted in the past are the use of treating agents for the yarn, the introduction of additives into the basic fiber-forming component of the yarn, the inclusion of metal wires or filaments in the yarn bundles, and the coating of fibers and filaments with metals. The modification of the basic fiber-forming composition and the treating of the yarn with various agents, while offering some improvement, provides only limited improvement, can be significantly humidity-dependent, and often is lost during the first year of yarn usage.

The use of metallic wires in yarns (e.g., in carpet usage) presents a number of serious problems. The metal wire is extremely difficult to camouflage and significantly affects the appearance of the yarn. The physical properties of the metal wire differ very significantly from the other filaments of the yarn and the wear characteristics and hand of the yarn are quite distinct. The presence of wire in a carpet, especially if plied, can cause significant streaking patterns in the carpet upon soiling or wearing as well as upon dyeing. The characteristics of the metal wires or filaments tend to be such that, upon wearing, they tend to break, presenting the problem of metal slivers in the carpet. The metal wires are so highly conductive that a shock hazard is presented should the carpet come in contact with house current, e.g., through defective wiring. Since metallic filaments cannot readily be textured in the same manner that, e.g., a nylon filament can be textured, it is customary to ply, that is, to double untextured metallic filaments with the carpet yarn. This produces a yarn having buried metallic exposed metalic fiber portions; the buried metallic yarn portion is essentially ineffective for static control and the exposed metallic yarn portion is easily damaged by normal traffic.

While various metal-coated filaments have been known in the art, the characteristics of such filaments are such that they are combined with yarns after formation of the yarn bundles and, thus, plying is the means employed for combining the metal-plated filaments with the yarn. The problems associated with such a structure are essentially the same as that described for plying of metal wires in carpet yarns.

SUMMARY

It has now been found that filamentary materials, such as a monofilament or yarn can be knit into a fabric to form a crimp in the filament or yarn. The fabric so formed can then be metal-plated by various techniques known in the art, and the plated fabric deknitted to provide a crimped, metal-coated filamentary material, such as a fiber (that is, a monofilament) or yarn, that is conductive over essentially its entire length. Further, the deknitted and plated filamentary material, such as a fiber or yarn, has a discernible crimp and therefore can be combined, e.g. entangled, as by doubling with other textured filaments to form a yarn in which the filaments are more cohesively intermingled as distinct from the relatively loosely plied yarns characteristically employed in the past. The so-textured, plated fiber (i.e., monofilament) or yarn has a significantly increased tendency to resist separation from the carpet yarn bundle, unlike the untextured, plated fibers heretofore utilized in the same manner. The conductive filamentary material is predominantly characterized by the properties of the substrate and has the same general modulus characteristics as the rest of the filamentary material in the carpet yarn. This not only contributes to durability in service but also further tends to minimize migration of the conductive filamentary material out of the yarn bundle to the top of the carpet or into the yarn bundle to the bottom. The conductive filmentary material or fiber, when of the same general denier as the other fiber components of the yarn, is essentially invisible in a finished carpet and remains so during service. Visibility is also reduced because the metal coating, particularly if silver, tends to reflect colors from dyed fibers adjacent to it. Moreover, the entangling or other combining process places the conductive filamentary material or fiber just under the surface of the carpet yarn where its anti-static properties can be best utilized. Unlike metallic wire, the plated filamentary material, such as a filament or yarn, is not so conductive as to present a shock hazard in the event of defective wiring contacting the carpet. For example, metal-plated nylon is not capable of carrying such large currents that the heat effect of such a current would tend to melt or otherwise destroy the substrate, thus breaking the circuit.

It has also been discovered that the anti-static properties of the metallized filament or yarn in a carpet can be further improved by heat-treating the crimped filament or yarn after it is metallized. Such filaments or yarns exhibit significantly lower shrinkage and less "pull-down" when incorporated into a carpet. The metallized fibers or yarns thus remain more securely in place at or near the surface of the carpet pile so that buildup of static electricity is more effectively prevented.

DETAILED DESCRIPTION

For the purposes of the present invention, any oxidatively stable and non-toxic metal may be used, e.g., nickel, copper, aluminum, silver, gold, platinum, tin. The process is applicable to any of the filamentary materials used in yarns characteristically employed in carpets including wool, nylon, polyester, and polyolefins, such as polypropylene. Each of these materials can be plated by any of the various means known in the art. The preferred techniques involve wet processing, i.e., the knitted fabric formed of the desired filamentary material constitutes the substrate which is passed into a bath of a salt of the metal to be deposited together with a reducing agent for the metal component of the salt. Commonly, the substrate is pe-sensitized to ensure effective plating on the knitted fabric. The foregoing may be illustrated by the plating of silver onto a knitted nylon fabric from an aqueous bath of silver nitrate and formaldehyde; the knitted nylon fabric substrate is commonly sensitized with a tin salt such as stannous chloride.

While the wet processing is preferred in that the silvering bath can more readily penetrate the knitted fabric and, thus, ensure plating even at the fiber crossover points, other techniques can also be employed. For example, metal sputtering techniques may be utilized to apply the metal to the knit fabric. Surprisingly, such techniques have been found also to be capable of providing an essentially continuous coating of metal on the fiber despite the existence of fiber crossover points in the fabric.

It is to be understood that in referring to a "continuous coating" it is not intended to imply that the coating is uniform around the circumference of the fiber or fibers being coated or even that the coating is uniformly deposited along a length of the fiber or of the fibers in a yarn. The expression is, however, intended to convey the idea that the fibers are conductive over most of their length, i.e., there is not a significant number of breaks in the electrical path such that the resistance of a one and one-half inch length of the fiber, or fibers in the case of a yarn, exceeds one million ohms. In general, the resistance of the conductive filaments incorporated in the yarns of the present invention is of the order of 300 ohms per inch length, although substantially greater resistance can be tolerated without detriment to the anti-static characteristics of the final yarn.

The metal-coated filamentary material of the invention, whether in the form of a monofilament or yarn, should be capable of being boiled in deionized water for two hours without serious increase in the electrical resistance thereof. Preferably, the resistance should not exceed 10,000 ohms per inch at the conclusion of the boiling water treatment. In the most preferred practice of the invention, the metal-plated filamentary material can be subjected to 30 minutes treatment at 180° F. in an aqueous bath containing 0.5 weight percent of sodium lauryl sulfate and sufficient sodium tripolyphosphate or trisodium phosphate to provide a pH of 9, followed by two hours in a boiling acetic acid solution at a pH of 5 without the electrical resistance increasing beyond 10,000 ohms/inch. As will be noted from examples, the resistance generally will be less than 1000 ohms/inch.

The procedures known in the prior art for providing a metal plating on fibers can be used as described previously. However, great care must be exercised in the practice of these techniques in order to obtain a plated fiber that will withstand the tests just described; and even then it is difficult to obtain such results on a consistently reproducible basis. The following examples I(A) and I(B) describe techniques which can be utilized for the silvering of nylon in order to ensure the obtaining of silver coating having the desired characteristics.

EXAMPLE I(A)

A fifteen denier, nylon 6 monofilament was knitted to form a continuous sleeve on a Textile Machine Works C-B-Tex Machine with a 400-needle knitting head at 48 courses per inch. The sleeve was not heat-set. The sleeve was then scoured for 30 minutes at 1800° F. in thirty parts by weight of a scouring liquor per part by weight of nylon; the liquor contained 0.5% each of t-octylphenoxypoly(9) ethoxyethanol and tetrasodium pyrophosphate based on the weight of fiber. The sleeve was then rinsed in cold water until all evidence of sudsing had disappeared, and was air-dried. The scouring treatment removes residual oils and other contaminants thereby preparing the filament of metallizing. The dried sleeve was metallized to 14% silver coating based on the weight of fiber and was then scoured in the manner just described, following which it was boiled in water for two hours. The metallized sleeve after drying was deknit on a cone winder at about 400 yards per minute to give 9° cones of silver-plated fiber which was crimped. Samples of the filament had resistance readings ranging from 500 to 900 ohms per one and one-half inches of fiber length.

EXAMPLE I(B)

A scoured sleeve of the type described above is sensitized with, for example, a solution of anhydrous stannic chloride in denatured ethyl alcohol (1 gram of salt per 10 ml. of solution). The sleeve is soaked for 5 minutes in the sensitizing solution, washed and then passed into a silvering bath prepared by adding in sequence, to 6300 ml. of water, 1.58 grams of sodium lauryl sulfate, 625 ml. of 0.30N silver nitrate solution, 612 ml. of 1N ammonium hydroxide, 160 ml. of 1N acetic acid (to bring the silvering bath pH to 9.0) and 371 ml. of 2.4% formaldehyde solution. The sleeve is retained in the bath for 165 minutes with occasional stirring and then removed from the bath, rinsed with water to remove the silvering solution, and dried. The metallized sleeve is then deknitted, as described above.

Monofilaments or yarns obtained in the manner described have excellent characteristics for use in the production of durable anti-static carpets. The metal-coated fibers can be incorporated into the carpet yarn by entanglement with non-metallized, crimped fibers in the manner known to the art, as by an air jet, to form a bulked yarn or they can be plied, e.g. twisted or doubled, with other yarn components, into the form of a bulked yarn. For most carpet usages, the metalcoated filament should not exceed about 30 denier or the hand and character of the resulting yarn will be significantly changed. In general, it is preferred that the coated filament be of the same general denier as the other filaments in the yarn bundle or finer. In some instances, there are certain advantages to the use of very fine denier metal-coated filaments as will be discussed subsequently.

In order to obtain the desired anti-static characteristics in the final carpet, it is not necessary that each yarn in the carpet contain the anti-static filament. Further, while not a limitation on the process or product, it is unnecessary that the yarn bundles contain more than one coated filament.

EXAMPLE II

To illustrate the above, carpet samples were prepared from 2600-denier, nylon 6 yarn containing 140 bulked, continuous filaments (about 18 denier each). An anti-static yarn was prepared from the same nylon yarn except that one of the nylon filaments was a silvered fiber (prepared essentially as in Example I) combined with non-metallized textured nylon fibers by air jet entanglement. In making the carpet samples, a sample was prepared first with just the standard nylon 6 yarn as a control and three additional samples were prepared in which the yarn containing the silver-coated fiber was employed in every 5th row, 9th row, and 13th row, respectively. The carpet samples were mock-dyed using a green acid dye, latexed and backed with jute by standard carpet-making methods. The carpet samples were tested at 35% relative humidity and 85° F. by having a person shuffle his feet across the respective carpet samples 20 times (wearing composition soles in one test and then leather soles in a second test), followed by bleeding off of the voltage through an electrometer to measure the voltage build-up on the individual person. Results of these tests are reported in Table I.

TABLE I

| Metal-coated Fiber in Carpet Sample | Static Buildup by Shuffling, volts | |
|---|---|---|
| | Composition Soles | Leather Soles |
| None — control | 12,000 | 16,000 |
| Every fifth row | 1,900 | 1,600 |
| Every ninth row | 2,800 | 2,800 |
| Every thirteenth row | 3,700 | 3,200 |

EXAMPLE III

Carpet produced as in Example II was wear-tested for 70,000 walk cycles and then tested for retention of static. The samples were then laundered in a commercial laundering machine to ensure that no extraneous materials had built up on the carpet and were tested for static retention. In each of the tests described, the "shuffling" test described in Example II was employed. Results of these tests were described in Table II.

TABLE II

| Metal-coated Fiber in Carpet Sample | Static Buildup by Shuffling, volts | |
|---|---|---|
| | Composition Soles | Leather Soles |
| | Original | |
| None — control | 9,000 | 11,000 |
| Every fifth row | 1,900 | 1,600 |
| | After 70,000 Walk Cycles | |
| None — control | 6,000 | 9,000 |
| Every fifth row | 1,500 | 2,000 |
| | Laundered After 70,000 Walk Cycles | |
| None — control | 12,500 | 12,500 |
| Every fifth row | 1,900 | 2,500 |

EXAMPLE IV

The tests of Examples II and III were repeated except that they were conducted under more severe conditions of 10% relative humidity and 70° F. temperature. Test results were essentially the same, varying no more than a few hundred volts from those set forth in Tables I and II.

EXAMPLE V

The tests for this example were essentially the same as those for Example II except that silvered fiber was plied into the yarn instead of entangled. The results of the tests of the carpets so produced are set forth in Table III.

TABLE III

| Metal-coated Fiber in Carpet Sample | Static Buildup by Shuffling, volts | |
|---|---|---|
| | Composition Soles | Leather Soles |
| None — control | 12,000 | 12,000 |
| Every third row | 800 | 900 |
| Every fifth row | 1,500 | 1,500 |

EXAMPLE VI

This example was essentially the same as Example III except that the silver-containing yarn was the plied yarn used in Example V. The results of this test taken immediately following a walk cycle are shown in Table IV (immediately following walk cycle).

TABLE IV

| Metal-coated Fiber in Carpet Sample | Static Buildup by Shuffling, volts | |
|---|---|---|
| | Composition Soles | Leather Soles |
| None — control | 9,000 | 9,000 |
| Every fifth row | 4,500 | 5,000 |

EXAMPLE VII

The silver-plated fiber was entangled with the yarn as in Example II and the resulting yarn was cut into 12-inch samples and each of the yarn samples was knot-coded for identification. The conductivity of the samples was measured and the samples were then placed in a ball mill. The conductivity of the samples was measured at ½ hour, 1 hour, and then every 15 minutes thereafter for 2 hours and 15 minutes. While the yarn samples were badly broken from the ball milling, none of the samples showed any sign of reduced conductivity.

In the examples the silvered fiber has been utilized in less than all of the carpet yarns. It is clear from the data of the tables that greater amounts are unnecessary and would, therefore, be uneconomical. However, the use of metal-coated fiber or fibers in every yarn of the carpet is contemplated as within the scope of the present invention. In particular, where it is desired to utilize metal-plated fiber in every yarn, a much finer denier filament can be incorporated in the otherwise standard yarn bundles, thereby further camouflaging its presence but without significantly detracting from its anti-static character. Thus, for example, the use of a three-denier, silver-coated nylon fiber in the carpet yarns described in the examples (and this yarn used in every carpet row) can be expected to provide anti-static characteristics roughly equivalent to those of the examples where the silver-containing yarn is used in every 9th row. It has also been found that the silver-coated filamentary materials described herein can also be advantageously utilized in staple fiber form in staple fiber yarns. In addition to the tests described above the carpet samples can also be tested in accordance with the procedures approved by the Technical Committee of the American Carpet Institute (now The Carpet and Rug Institute) on Aug. 19, 1963 as their "Test Method for Determining the Static Propensity of Carpets" with substantially the same results described above.

A significant facet of the present invention is found when crimped metal-coated fiber is cohesively intermingled in a yarn intended for carpet-tufting use. The other yarn fibers are textured, e.g., by crimping, and the crimped, metal-coated fiber is randomly mixed in the yarn bundle such that the yarn filaments cannot readily be separated from each other without filament breakage (this can be recognized by holding a length of yarn at one end, placing the point of a pencil in the yarn, and attempting to move the pencil longitudinally through the yarn). Various methods, including mechanical and pneumatic methods are known in the art for effecting this intermingling of yarn components. The resulting yarn can be readily tufted in a carpet without significant breakage of the conductive filament. The combined effects of crimping and intermingling provide the conductive filament with a substantial margin of safety from the tufting needles and/or operation that is not found with other types of conductive filaments. Further, carpets produced using such yarns retain the antistatic characteristics for significantly extended periods, apparently due to decreased tendency for the metal coating to be lost as the result of abrasion. Additional improvement is noted when the tufted pile is subsequently cut, as in shag construction, due to greater exposure of the metallized filaments. It will be recognized, therefore, that a tufted, cut pile carpet containing a substantial portion of a cohesively intermingled yarn at least one filament of which is a crimped, metal-coated fiber, particularly silvercoated nylon, is an extremely important embodiment of the present invention.

HEAT TREATMENT

Substantial additional improvement in preventing static-build-up is provided by heat-treating the crimped fiber (filament or yarn) after the fiber is metallized.

The improved static resistance due to heat treatment was discovered accidentally as a result of the observation that the metallized fiber in carpet samples made from the fibers which has been heat treated was more visible than in other samples. Investigation revealed that the metallized fiber in the former samples had pulled down less in the carpet. This was confirmed by standard shrinkage tests on skeins of metallized fiber. The carpet samples made from heat-treatment fibers exhibited significantly less shrinkage than those which had not been heat-treated. The significantly improved static resistance in the carpets is probably due to the fact that the low shrinkage metallized fibers remain at a higher elevation in the carpet and therefore provide more continuous contact with a static electricity generating source. The heat treatment is believed to more completely set the crimp of the knit structure into the fiber. The crimp therefore remains in the fiber during and after the metallizing step, resulting in improved cohesiveness with other fibers in the yarn bundles, less shrinkage and ultimately more stability (less "pull-down") in carpets made from the yarns.

The fiber is heat-treated after it has been metallized whether or not it has been deknitted. Preferably, from the standpoint of convenience, it is heat-treated after it has been deknitted and wound onto cones. Generally, the cones of the metallized, deknitted fiber (or the metallized fiber plied or intermingled with non-metallized fiber) are heated at about 230° F. to about 270° F. for about 30 to about 120 minutes, e.g., about 255° F. for about 60 minutes. Optimum conditions for heat-treating depend on various factors such as the character of the crimp, geometry of the cone and density of the fiber on the cone. While standard ovens may be utilized for this purpose, other heating means and environments may also be employed. For example, steam box heat-treating is even more effective in reducing shrinkage. However, this method is more expensive than oven heating.

It is also feasible to heat-treat the metallized fiber on parallel-sided tubes rather than cones, for example, on the tubes on which the metallized fiber is wound after deknitting and before combination with non-metallized fiber. This is less peferred to heat-treating of cones, however, due to somewhat non-uniform results.

It has been found that any combination of heat treating conditions which provide shrinkage measurements of no more than 1–5%, preferably about 3% as an average, as determined after one hour on skeins of the metallized fibers in accordance with the well-known Leesona Skein Shrinkage test, will be most effective for improving resistance to static buildup. (In this test, a 15 wrap, 27 inch skein of the metallized fiber is weighted with a 1 gram weight and immersed in water at 180° F. for 10 minutes. The skein is then removed from the water and hung with the gram weight thereon to tension it. The length of the hanging skein is measured after 2 minutes and 1 hour. The percentage differences between these lengths and the original 27 inch length are the percent shrinkages.) To some extent, more severe scouring of the unmetallized fiber in knit form will also contribute to low shrinkage. However, it has been found that severe scouring is not required for the 1–5% shrinkage and that, given standard scouring conditions, the shrinkage measurements correlate well with the heat treatment conditions.

EXAMPLE VIII

A silvered nylon fiber was prepared essentially as described in Example I(B) except that the fiber was a 20 denier 7 filament yarn which was scoured twice before metallizing. The silvered fiber was heat-treated by oven-heating it on cones for 2 hours at 240° F. After the heat treatment, samples of the fibers were combined with 2600 denier/bulked nylon to form a yarn, the yarn then being formed into carpet samples (shag) essentially as described in Example II, except for plying of the silvered nylon with the parent nylon at the creel before tufting rather than air jet entangling of the fibers, and except for different densities of metallized fiber in the carpet samples and absence of backing in some samples. Test results for carpets made from the metallized fiber batches are given in Table V where samples A and B are control samples (non-heat-treated fiber) and samples A′ and B′ are samples made from fibers heat-treated in accordance with this Example. The tests show the improved static resistance resulting from the heat treatment as well as the reduced shrinkage.

TABLE V

| Metal-coated Fiber in Carpet Sample | Static Buildup (volts) Leather Soles | | | |
|---|---|---|---|---|
| | Unbacked Carpet Samples | | | |
| Batch | A | A′ | B | B′ |
| None (control) | 14800 | 14800 | 14800 | 14800 |
| Every 8th end | 2800 | 2150 | 3700 | 2900 |
| Every 16th end | 3600 | 3150 | 5300 | 3850 |
| Every 24th end | 4450 | 3700 | 6650 | 4750 |
| | Carpet Samples Backed with Latex-Jute | | | |
| None (control) | 15300 | 15300 | 15300 | 15300 |
| Every 8th end | 3200 | 2550 | 4450 | 3550 |
| Every 16th end | 3850 | 3450 | 5900 | 4450 |
| Every 24th end | 4600 | 4050 | 6500 | 5450 |
| | Shrinkage[1] | | | |
| | 5% | 4% | 10% | 7% |

[1]Leesona Skein Shrinkage test, measurement after 1 hour.

What is claimed is:

1. A process for producing a textured multi-filament yarn suitable for use in the production of textiles having an enhanced resistance to the accumulation of electrostatic charges, said process comprising:

knitting a continuous filamentary material, suitable for use in carpet fiber or carpet yarn, to form a knitted fabric therefrom, depositing an electrically conductive oxidatively stable and non-toxic metal coating on said knitted fabric, deknitting the coated fabric to provide a textured, coated filamentary material, and incorporating said textured, coated filamentary material in a textured multifilament yarn, and wherein, after the metal coating step, the knitted fabric, deknitted filamentary material, or textured multifilament yarn is heat-treated such that shrinkage of the filamentary material according to the Leesona Skein Shrinkage test is no more than 1–5% measured after one hour.

2. The process of claim 1 wherein said metal coated filamentary material is heat-treated after knitting and before incorporating in said multifilament yarn.

3. The process of claim 2 wherein said filamentary material is continuous nylon filament and said metal coating is silver.

4. The process of claim 1 wherein said coated filamentary material is heat-treated after deknitting.

5. The process of claim 1 wherein said coated filamentary material is heat-treated at about 230°–270° F. for about 30–120 minutes.

6. The process of claim 1 wherein said filamentary material is continuous nylon filament and said metal coating is silver.

7. The process of claim 5 wherein said coating is deposited by reducing an aqueous solution of a silver salt with formaldehyde.

8. The process of claim 5 wherein said filamentary nylon is sensitized by treatment thereof with a solution of a tin salt before the depositon thereon of said coating.

9. A textured multifilament yarn, suitable for use in the manufacture of textiles having an enhanced resistance to the accumulation of electrostatic charge, produced in accordance with the process of claim 1.

10. A textured multifilament yarn, suitable for use in the manufacture of textiles having an enhanced resistance to the accumulation of electrostatic charge, produced in accordance with the process of claim 2.

11. A textured multifilament yarn, suitable for use in the manufacture of textiles having an enhanced resistance to the accumulation of electrostatic charge, produced in accordance with the process of claim 6.

12. A textured multifilament yarn suitable for use in the manufacture of textiles having an enhanced resistance to the accumulation of electrostatic charge, produced in accordance with the process of claim 3.

13. In a carpet characterized by a static electrical buildup of substantially less than 10,000 volts, the improvement comprising forming at least a portion of the pile thereof with the textured multifilament yarn of claim 9.

14. In a carpet characterized by a static electrical buildup of substantially less than 10,000 volts, the improvement comprising forming at least a portion of the pile thereof with the textured multifilament yarn of claim 10.

15. In a carpet characterized by a static electrical buildup of substantially less than 10,000 volts, the improvement comprising forming at least a portion of the pile thereof with the textured multifilament yarn of claim 11.

16. In a carpet characterized by a static electrical buildup of substantially less than 10,000 volts, the improvement comprising forming at least a portion of the pile thereof with the textured multifilament yarn of claim 12.

* * * * *

UNITED STATES PATENT OFFICE

CERTIFICATE OF CORRECTION

Patent No. 4,042,737 Dated August 16, 1977

Inventor(s) Klane F. Forsgren et al.

It is certified that error appears in the above-identified patent and that said Letters Patent are hereby corrected as shown below:

Column 9, Claim 3, line 1, "claim 2" should read -- claim 1 --.

Column 9, Claim 7, line 1, "claim 5" should read -- claim 6 --.

Column 9, Claim 8, line 1, "claim 5" should read -- claim 6 --.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*